US008734266B2

(12) United States Patent
David

(10) Patent No.: US 8,734,266 B2
(45) Date of Patent: May 27, 2014

(54) GOLF PUTTER HEAD, GOLF PUTTER HAVING SUCH A GOLF PUTTER HEAD, AND METHOD OF USING THE GOLF PUTTER

(75) Inventor: Tom David, Nantucket, MA (US)

(73) Assignee: Tom David, Inc., Nantucket, MA (US)

( * ) Notice: Subject to any disclaimer, the term of this patent is extended or adjusted under 35 U.S.C. 154(b) by 151 days.

(21) Appl. No.: 13/406,750

(22) Filed: Feb. 28, 2012

(65) Prior Publication Data

US 2013/0225306 A1 Aug. 29, 2013

(51) Int. Cl.
*A63B 69/36* (2006.01)
*A63B 53/04* (2006.01)

(52) U.S. Cl.
USPC ..... 473/251; 473/252; 473/313; 473/314; 473/324; 473/340; 473/409

(58) Field of Classification Search
CPC .... A63B 53/00; A63B 53/04; A63B 69/3685; A63B 53/0487; A63B 2053/0441
USPC ..... 473/324–350, 251–255, 287–292, 313, 473/314, 409
See application file for complete search history.

(56) References Cited

U.S. PATENT DOCUMENTS 3,652,093 A 3/1972 Reuter, Jr.
D231,624 S * 5/1974 Wilmoth ..... D21/741
3,944,231 A 3/1976 Johnson
3,967,826 A 7/1976 Judice
4,063,733 A * 12/1977 Benedict ..... 473/313
4,824,115 A 4/1989 Walther
4,834,387 A 5/1989 Waites et al.
5,273,282 A * 12/1993 Cannon ..... 473/252
5,290,035 A 3/1994 Hannon et al.
5,454,564 A 10/1995 Kronogard
5,470,068 A * 11/1995 Schmidt et al. ..... 473/311
(Continued)

FOREIGN PATENT DOCUMENTS

CA 2149473 A1 11/1996
JP 2005124806 A 5/2005
JP 3132758 U 5/2007

OTHER PUBLICATIONS

Pelz O-Ball Modified Odyssey Putter, [online], [retrieved Feb. 24, 2012] Retrieved using Internet <URL:http://www.pelzgolf.com/dave_pelz_golf_pro_shop/golf_putter_odyssey_white_ice_f7.aspx>, 1 page.

(Continued)

*Primary Examiner* — Sebastiano Passaniti
(74) *Attorney, Agent, or Firm* — Venable LLP; Robert Kinberg

(57) ABSTRACT

A golf putter head includes a contact face, a top surface extending rearwardly away from the contact face, a toe edge, a heel edge, and a sole spaced from the top surface. A center of gravity of the putter head is disposed closer to the toe edge than to the heel edge. A visual sight line is provided on the top surface and extends rearwardly away from the contact face, wherein the visual sight line and the center of gravity lie in a sight line plane disposed perpendicular to the top surface and to the contact face. The toe edge extends rearwardly away from the contact face and parallel to the visual sight line. A golf putter is also provided including a shaft and the golf putter head connected to an end of the shaft. A method of using a golf putter includes utilizing the golf putter to strike a golf ball.

21 Claims, 9 Drawing Sheets

(56) References Cited

U.S. PATENT DOCUMENTS

| | | | | |
|---|---|---|---|---|
| D380,513 | S * | 7/1997 | Noda | D21/736 |
| 5,690,556 | A * | 11/1997 | Condon | 473/252 |
| 5,720,668 | A | 2/1998 | Brett | |
| 5,782,706 | A | 7/1998 | DePriest | |
| 5,800,279 | A | 9/1998 | Densberger et al. | |
| D403,387 | S | 12/1998 | Bloomer | |
| 5,913,731 | A | 6/1999 | Westerman | |
| 5,976,025 | A | 11/1999 | Williams | |
| 6,039,656 | A * | 3/2000 | Fireman | 473/131 |
| 6,264,571 | B1 | 7/2001 | Lekavich | |
| 6,409,613 | B1 * | 6/2002 | Sato | 473/337 |
| 6,485,375 | B1 | 11/2002 | McKinley | |
| 6,533,679 | B1 | 3/2003 | McCabe et al. | |
| D472,595 | S | 4/2003 | Tang et al. | |
| 6,616,546 | B2 | 9/2003 | Cho | |
| 6,716,110 | B1 | 4/2004 | Ballow | |
| 6,846,245 | B2 | 1/2005 | Baron | |
| 6,923,734 | B2 | 8/2005 | Meyer | |
| D518,124 | S | 3/2006 | Fain | |
| D518,125 | S | 3/2006 | Fain | |
| 7,052,409 | B2 | 5/2006 | Goldsmith | |
| 7,371,187 | B2 | 5/2008 | Moriyama et al. | |
| D571,877 | S | 6/2008 | Jones et al. | |
| D574,906 | S | 8/2008 | Jones et al. | |
| 7,473,189 | B2 | 1/2009 | Schweigert et al. | |
| D594,517 | S | 6/2009 | Tang et al. | |
| 7,625,299 | B2 | 12/2009 | Fujimoto | |
| 7,691,004 | B1 | 4/2010 | Lueders | |
| 7,789,764 | B2 | 9/2010 | Wilson et al. | |
| 7,850,538 | B1 | 12/2010 | Yoon | |
| 7,862,451 | B2 | 1/2011 | Harvell et al. | |
| 7,918,745 | B2 | 4/2011 | Morris et al. | |
| D684,226 | S * | 6/2013 | David | D21/743 |
| 2006/0281578 | A1 | 12/2006 | Pedraza et al. | |
| 2007/0042831 | A1 | 2/2007 | Haines et al. | |
| 2009/0186717 | A1 | 7/2009 | Stites et al. | |
| 2010/0267461 | A1 | 10/2010 | Stites | |
| 2011/0009205 | A1 | 1/2011 | Oldknow et al. | |

OTHER PUBLICATIONS

Pelz O-Ball Modified Odyssey Putter, [online], [retrieved Feb. 28, 2012] Retrieved using Internet <URL:http://www.pelzgolf.com/dave_pelz_golf_pro_shop/golf_putter_odyssey_white_ice_vline.aspx>, 1 page.

Pelz O-Ball Modified Odyssey White Ice Putter, [online], [retrieved Feb. 28, 2012] Retrieved using Internet <URL:http://www.pelzgolf.com/dave_pelz_golf_pro_shop/golf_putter_odyssey_white_ice_center.aspx>, 1 page.

Odyssey Divine Putters, Nov. 8, 2010, [online], [retrieved Feb. 28, 2012] Retrieved using Internet <URL: http://golf.about.com/od/equipmentreviews/ig/New-Equipment—11-08-10/Odyssey-Divine-2-Ball-Putter.htm?p=1>, 2 pgs.

More News on Black Hawk Putter, Jan. 18, 2012, [online], [retrieved Feb. 28, 2012] Retrieved using Internet URL:http://blackhawkputter.com/?tag=orion-golf, 3 pgs.

* cited by examiner

GOLF PUTTER HEAD, GOLF PUTTER HAVING SUCH A GOLF PUTTER HEAD, AND METHOD OF USING THE GOLF PUTTER

CROSS REFERENCE TO RELATED APPLICATIONS

None.

BACKGROUND

1. Field of Invention

The invention relates generally to a golf club and golf club head, and more particularly, to a putter-type golf club and golf club head.

2. Related Art

Since the earliest origins of the game of golf, golfers have sought improved techniques and equipment that will enhance their performance and, consequently, result in reduced scores. Accordingly, golf equipment technology across all club types (woods, irons, hybrids, putters, etc.) has progressed over time. Putter designs, in particular, have experienced a recent resurgence in innovative designs and configurations alleged to assist professionals and amateurs alike in shaving a stroke or two off of the scorecard.

Aside from requiring the ability to correctly read putting greens, it is well understood that two key fundamental aspects of good putting involve hitting the ball (1) in the desired direction and (2) with the correct force. If a golfer mishits a putt by incorrectly executing either or both of these aspects, the result is a missed putt and, in many cases, a difficult subsequent putt.

While the latter aspect is primarily based on user skill, practice and experience in developing a feel for how hard to stroke a ball given certain conditions such as distance, green conditions (speed, slope), and familiarity with the physical characteristics of a given putter, etc., the former aspect is largely controlled by two factors: stroke path and face angle at impact. Attempts to help golfers improve both stroke path and face angle have previously been addressed by including visual features on the putter head (e.g., directional indicator lines, one or more golf ball sized circular features, etc.) and/or on the ball (e.g., linear text or user-drawn lines) to assist in initial alignment. Moreover, use of different putter materials and/or construction has also been used to help provide forgiveness for slight mishits during the putting stroke. Past and current putters, however, are typically constructed with the intention that the golfer both aligns and strikes the ball near the geometrical center of the contact face between the toe and heel. What is needed is an improved golf putter head that provides better feel and visual reinforcement both before and during the putting stroke to improve initial alignment as well as stroke path and face angle at impact to engender confidence in the golfer.

SUMMARY

In accordance with an embodiment of the invention, a golf putter head includes a contact face, a top surface extending rearwardly away from the contact face, a toe edge, a heel edge, and a sole spaced from the top surface. A center of gravity of the putter head is disposed closer to the toe edge than to the heel edge. A visual sight line is provided on the top surface and extends rearwardly away from the contact face, wherein the visual sight line and the center of gravity lie in a sight line plane disposed perpendicular to the top surface and to the contact face. The toe edge extends rearwardly away from the contact face and parallel to the visual sight line.

In accordance with another embodiment of the invention, a golf putter may include a shaft and the aforementioned golf putter head connected to an end of the shaft.

In accordance with another embodiment of the invention, a method of putting a golf ball includes utilizing the aforementioned golf putter to strike a golf ball.

Further features and advantages, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of some embodiments of the invention, as illustrated in the accompanying drawings. Unless otherwise indicated, the accompanying drawing figures are not to scale. Several embodiments of the invention will be described with respect to the following drawings, in which like reference numerals represent like features throughout the figures, and in which.

DETAILED DESCRIPTION

Some embodiments of the invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the invention.

Certain terms are used herein to address particular sections of the putter-type golf club head. For example, the "heel" of a golf club head generally refers to the portion of the golf club head that is closest to a golfer when the golfer is addressing the golf club head in a normal playing stance. The "toe" of the golf club head, for example, generally refers to the portion of the golf club head that is furthest from the golfer when the golfer is addressing the golf club head in a normal playing stance. The "front" of the golf club head, for example, generally refers to the portion of the golf club head directly adjacent to and/or including the contact face (ball striking face) of the golf club head. The "rear" of the golf club head, for example, generally refers to the portion of the club head farthest from the contact face of the golf club head. For example, the "sole" of the golf club head generally refers to the portion of the golf club head arranged to rest on the ground or playing surface when the golfer is addressing the golf club head in a normal playing stance. For example, the "top" or "crown" of the golf club head generally refers to the portion of the golf club head facing upward and away from the ground or playing surface when the golfer is addressing the golf club head in a normal playing stance.

Figure 1:
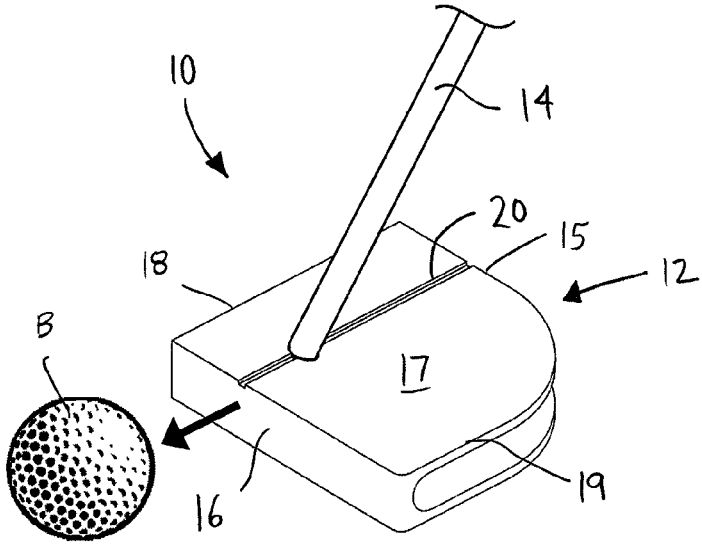
FIG. 1 is a perspective view of a golf putter according to an embodiment of the invention.

FIG. 1 is a perspective view of a golf putter 10 according to an embodiment of the invention. The putter 10 includes a putter head 12 connected at an end of a golf club shaft 14. The putter head 12 may include a contact face 16, a top surface 17 extending rearwardly away from the contact face 16, a toe edge 18, and a heel edge 19. A visual sight line 20 may be provided on the top surface 17 and extending rearwardly away from the contact face 16. The visual sight line 20 is disposed closer to the toe edge 18 than to the heel edge 19 and extends parallel to the toe edge 18. The visual sight line 20 may be in the form of an elongated recessed slot and may be colored differently from at least the top surface 17. Alternatively, the visual sight line 20 may simply be an elongated colored line or strip on the top surface 17 (e.g., without a recessed slot) or the visual sight line 20 could include an elongated colored ridge (not shown) protruding from the top surface 17. As shown in FIG. 1, the optimal point of contact for striking the golf ball B, otherwise known as the "sweet spot," is indicated by the visual sight line 20 and is likewise disposed closer to the toe edge 18 than to the heel edge 19. One or both of the toe edge 18 and visual sight line 20 may extend rearwardly all the way to a rear 15 of the putter head 12 and the lengths of the visual sight line 20 and the toe edge 18 may be substantially equal.

Figure 2:
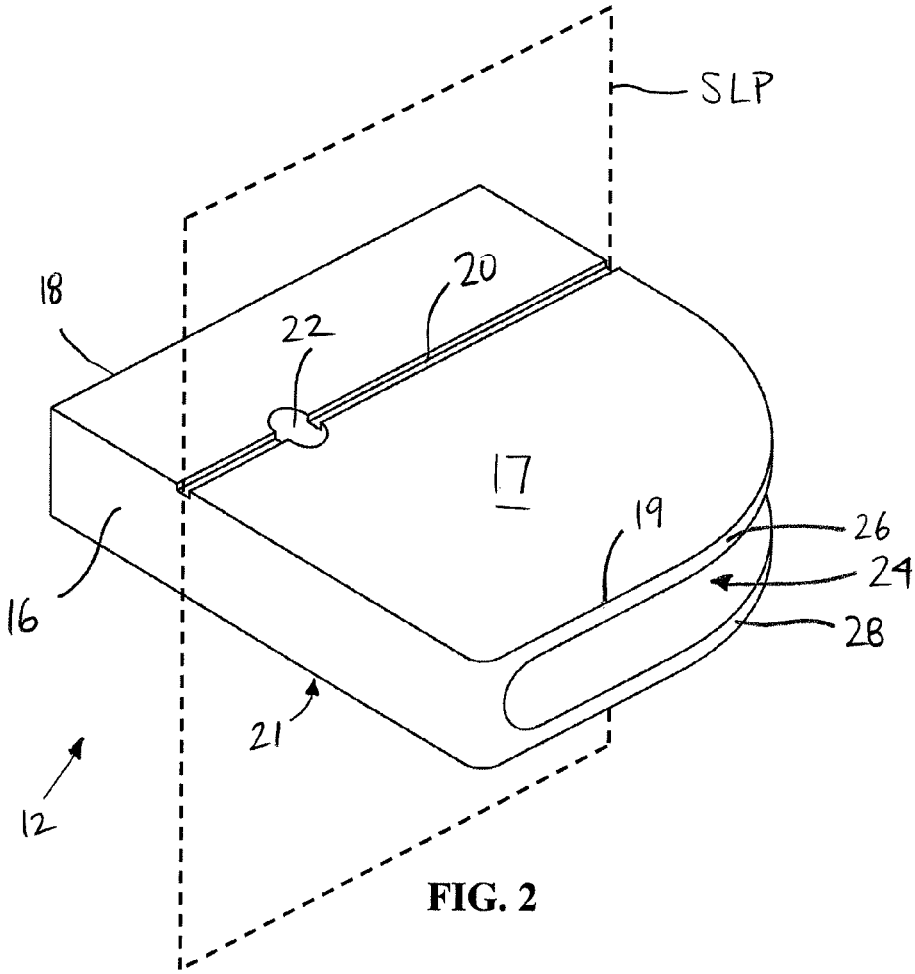
FIG. 2 is perspective view of the putter head of the golf putter of FIG. 1.

FIG. 2 is a perspective view of the putter head 12 of FIG. 1. As shown in FIG. 2, the visual sight line 20 defines a sight line plane SLP arranged perpendicular to the top surface 17 and to the contact face 16. A center of gravity CG (not shown in FIG. 2) may be disposed within the sight line plane SLP between the top surface 17 and a sole 21 of the putter head 12. Consequently, the center of gravity CG of the putter head 12 is disposed closer to the toe edge 18 than to the heel edge 19. A shaft receiving and connection portion 22 (hosel) is also provided proximate the front of the putter head 12 and may intersect the sight line plane SLP within the putter head 12. The shaft receiving and connection portion 22 could also be positioned elsewhere on the putter head 12. In this case, an axis of a main portion of the shaft 14 may still intersect the sight line plane SLP between the top surface 17 and a sole 21 of the putter head 12 if, for example, an end region of the shaft is angled (not shown) prior to its attachment to the putter head 12. If the shaft receiving and connection portion 22 (hosel) and/or the axis of the shaft 14 intersect the center of gravity CG of the putter head 12 (see FIGS. 3 and 4), the toe biased putter head 12 will be face balanced even with the center of gravity CG being closer to the toe edge 18. As shown in the embodiment depicted in FIG. 2, a portion of the putter head 12 proximate the heel edge 19 may be hollowed out to define an interior volume 24 positioned between top and bottom flanges 26, 28. The hollow interior volume 24 may serve to move the center of gravity CG toward the toe edge 18. Alternatively, or in addition, at least a portion of the space between the top surface 17 and the sole 21 may filled with a material having a different density than the material of the remainder of the putter head 12.

Figure 3:
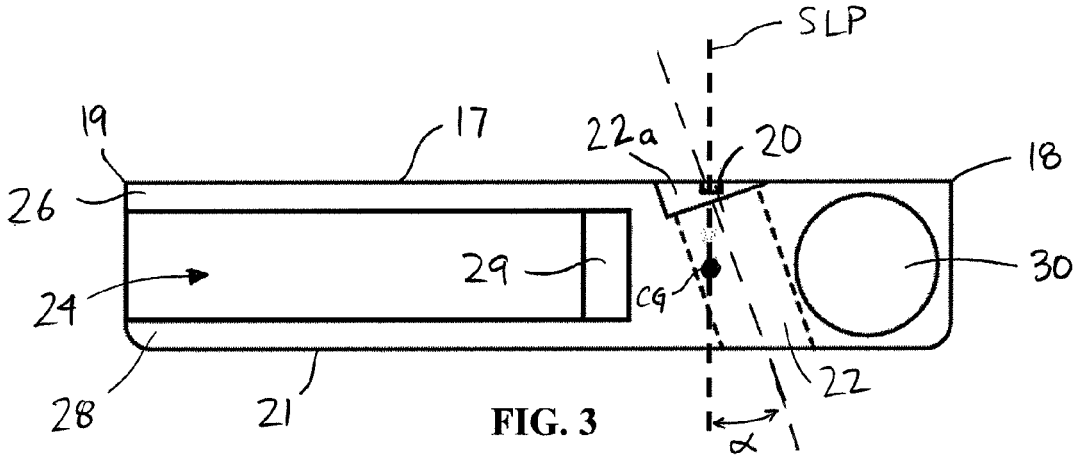
FIG. 3 is a rear view of the putter head of FIG. 2.
Figure 4:
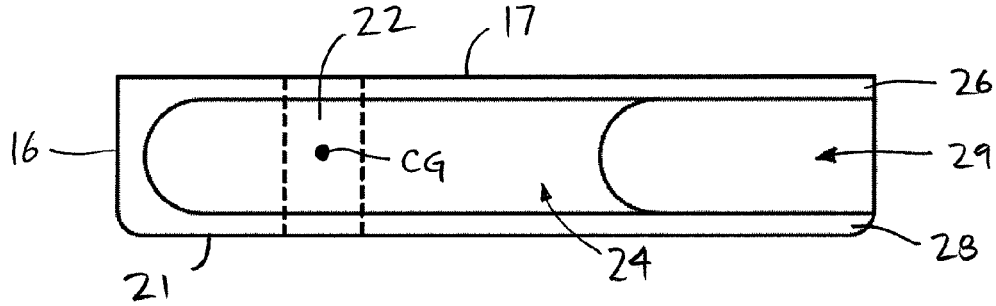
FIG. 4 is a side view of the putter head of FIG. 2 as viewed from the heel of the putter head.
Figure 5:
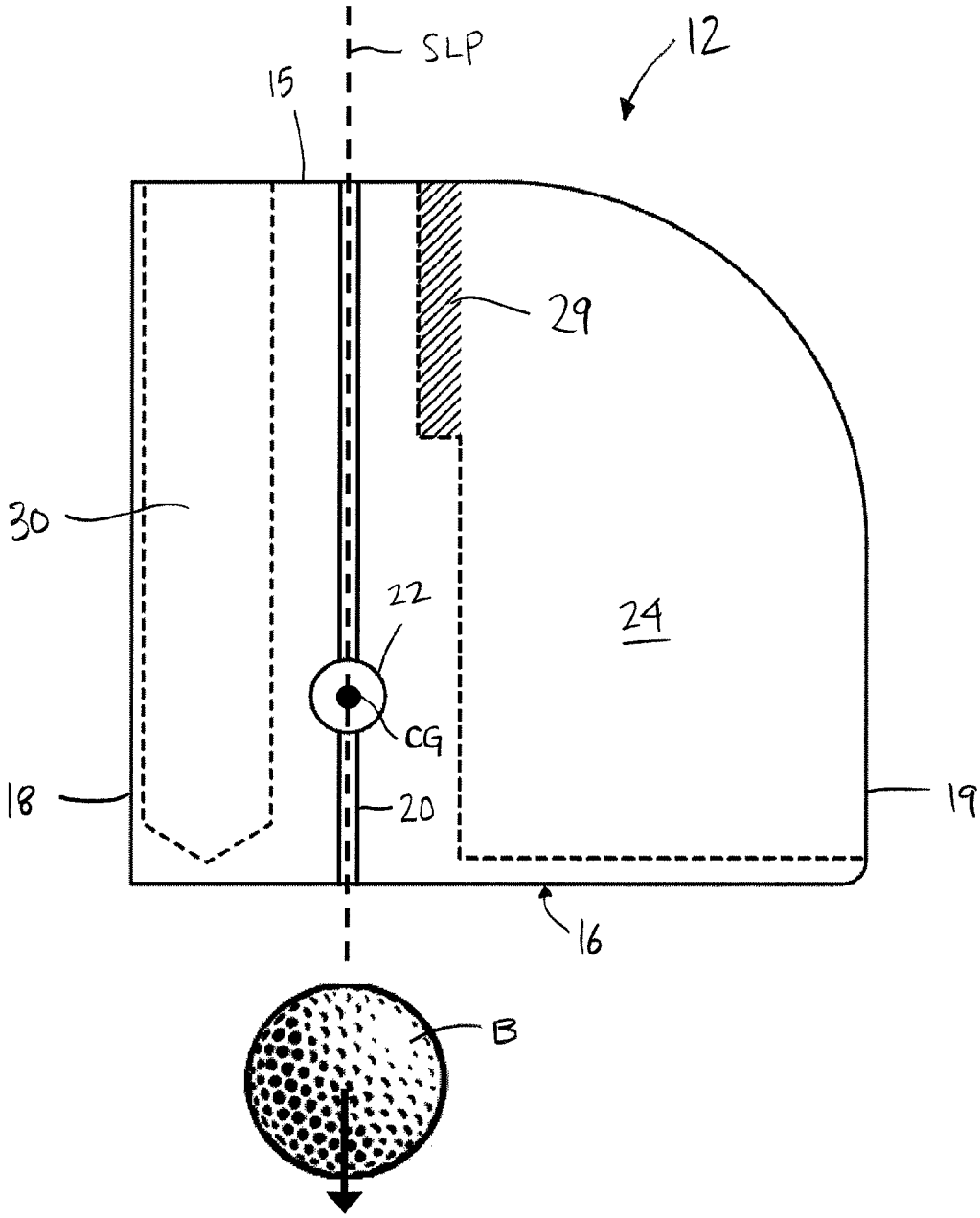
FIG. 5 is a top view of the putter head of FIG. 2, showing some example internal features in dashed lines and hatching.

FIG. 3 is a rear view of the putter head 12 of FIG. 2. FIG. 4 is a side view of the putter head 12 as viewed from the heel edge 19. FIG. 5 is a top view of the putter head 12. As shown in FIG. 3, the sight line plane SLP is arranged perpendicular to the top surface 17 and both the visual sight line 20 and the center of gravity CG of the putter head 12 are positioned in the sight line plane SLP. The shaft receiving and connection portion (hosel) 22 may include a through hole extending at an angle between the top surface 17 and the sole 21. The shaft receiving and connection portion 22 intersects the sight line plane SLP within the putter head 12 and may define an angle $\alpha$, for example, of at least approximately 10 degrees between the sight line plane SLP and the axis of the shaft receiving and connection portion 22. A recessed shoulder portion 22*a* of the hosel 22 may be provided proximate the top surface 17 to accommodate the bottom of a shaft (not shown) and help hide the connection between the shaft and the putter head 12. Such connection may include, for example, a post or connector (not shown) rigidly fixed within the shaft receiving and connection portion 22 and also received and rigidly fixed within the shaft. Referring to FIGS. 3 and 4, the hollow interior volume 24 between the flanges 26, 28 may include one or more weight cavities 29 provided on the heel side of the sight line plane SLP and toward the rear 15 of the putter head 12 for adding or removing mass to adjust the position of the center of gravity CG. As shown in FIGS. 3 and 5, another weight cavity 30 may be provided proximate the toe edge 18 and having a weighted slug received therein to ensure that the center of gravity CG is closer to the toe edge 18 than to the heel edge 19.

Figure 6:
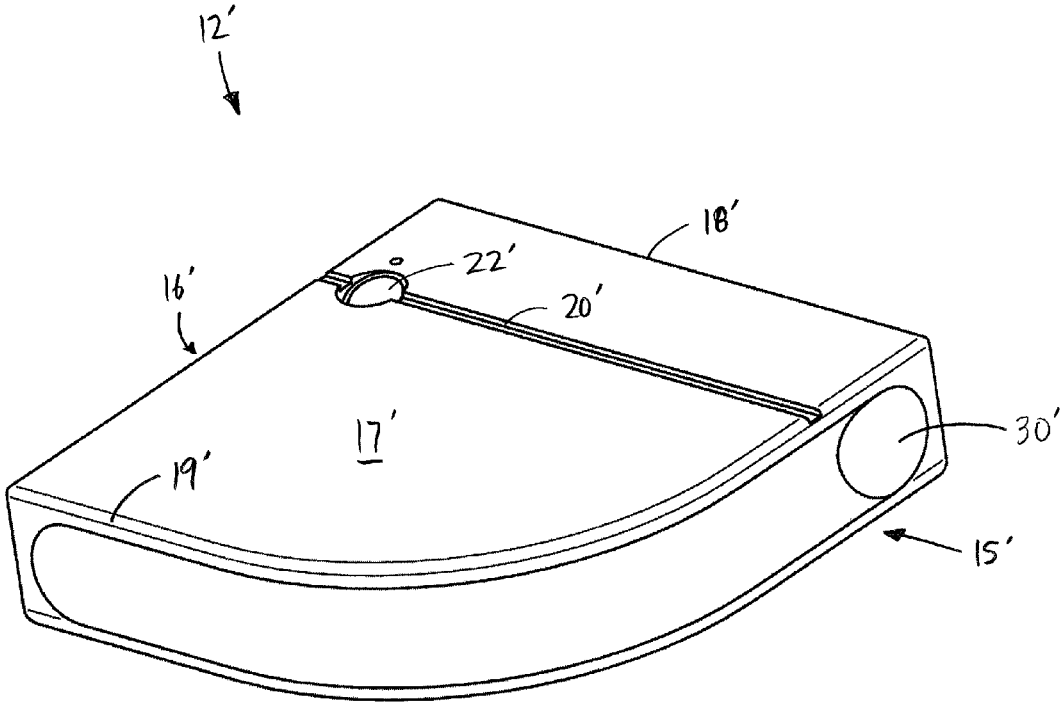
FIG. 6 is a perspective view of a putter head according to another embodiment.
Figure 7:
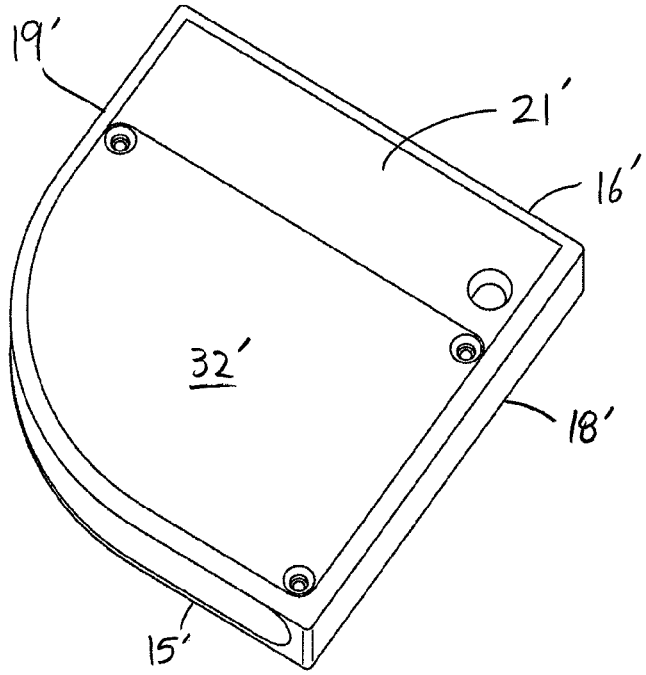
FIGS. 7 and 8 are bottom perspective views of the putter head of FIG. 6 shown with and without a bottom cover, respectively.
Figure 8:
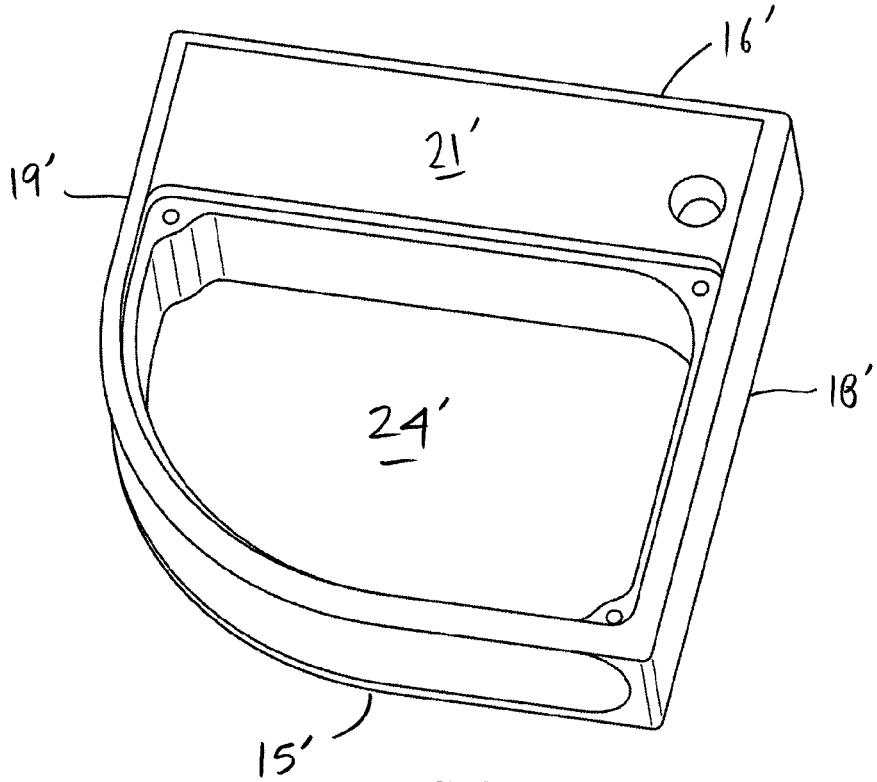

FIGS. 6-8 are top and bottom perspective views of a putter head 12' according to another embodiment. The putter head 12' is substantially the same as the putter head 12 shown in FIGS. 1-5 except that the heel edge 19' and rear 15' are closed. The putter head 12' may include a contact face 16', a top surface 17' extending rearwardly away from the contact face 16', a toe edge 18', and a heel edge 19'. A visual sight line 20' may be provided on the top surface 17' and extending rearwardly away from the contact face 16'. The visual sight line 20' is disposed closer to the toe edge 18' than to the heel edge 19' and also extends parallel to the toe edge 18'. As in FIG. 2, the visual sight line 20' is in the sight line plane SLP which is perpendicular to the contact face 16' and to the top surface 17', parallel to the toe edge 18', and runs through the center of gravity CG. One or both of the toe edge 18' and visual sight line 20' may extend rearwardly all the way to a rear 15' of the putter head 12'. As shown in FIGS. 7 and 8, the putter head 12' may include a hollow interior volume 24' (see FIG. 8) which may be fully or partially enclosed by a cover panel 32' (see FIG. 7). The cover panel 32' may be removably attached to the sole 21' of the putter head 12' by known attachment mechanisms such as, for example, screws or other fasteners, snap-fit, friction-fit, or the like.

Figure 9:
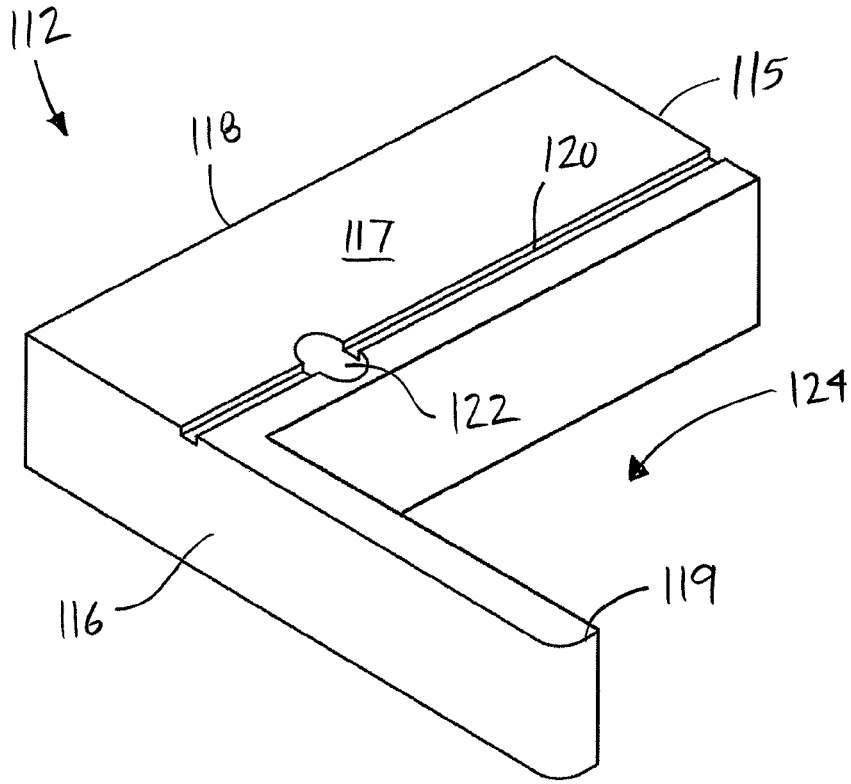
FIG. 9 is a perspective view of a putter head according to yet another embodiment.

FIGS. 9-14 depict some perspective views of the putter head according to other example embodiments. The putter heads shown are included for illustrative purposes only and should not be construed as limiting. In FIG. 9, for example, the putter head 112 is substantially the same as the putter head 12 shown in FIGS. 1-5 except that the top and bottom flanges 26, 28 are removed such that a large volume 124 from the heel edge 119 toward the visual sight line 120 is open. In this instance, the putter head 112 may be substantially L-shaped and includes a contact face 116, a top surface 117 extending rearwardly away from the contact face 116, a toe edge 118, and the heel edge 119. The visual sight line 120 may be provided on the top surface 117 and extends rearwardly away from the contact face 116. As in the embodiment shown in FIG. 2, the visual sight line 120 is in the sight line plane SLP which contains the center of gravity. The sight line plane SLP is disposed closer to the toe edge 118 than to the heel edge 119 and extends parallel to the toe edge 118 and perpendicular to the contact face 116. One or both of the toe edge 118 and visual sight line 120 may extend rearwardly all the way to a rear 115 of the putter head 112.

Figure 10:
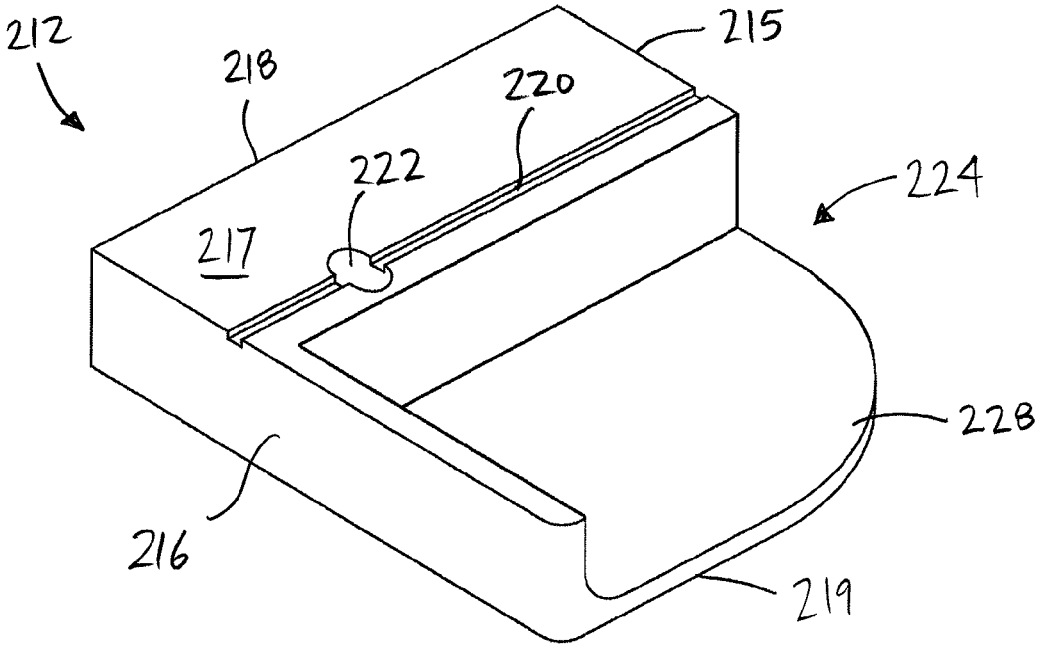
FIG. 10 is a perspective view of a putter head according to still another embodiment.

In the embodiment depicted in FIG. 10, for example, the putter head 212 is substantially the same as the putter head 112 shown in FIG. 9 except that the bottom flange 228 is provided such that volume 224 between the visual sight line 220 and the heel edge 219 is bound on the bottom. In this instance, the putter head 212 includes a contact face 216, a top surface 217 extending rearwardly away from the contact face 216, a toe edge 218, and the heel edge 219. The visual sight line 220 may be provided on the top surface 217 and extends rearwardly away from the contact face 216. The visual sight line 220 and the center of gravity are disposed closer to the toe edge 218 than to the heel edge 219 and the visual sight lint 220 extends parallel to the toe edge 218. One or both of the toe edge 218 and visual sight line 220 may extend rearwardly all the way to a rear 215 of the putter head 212.

Figure 11:
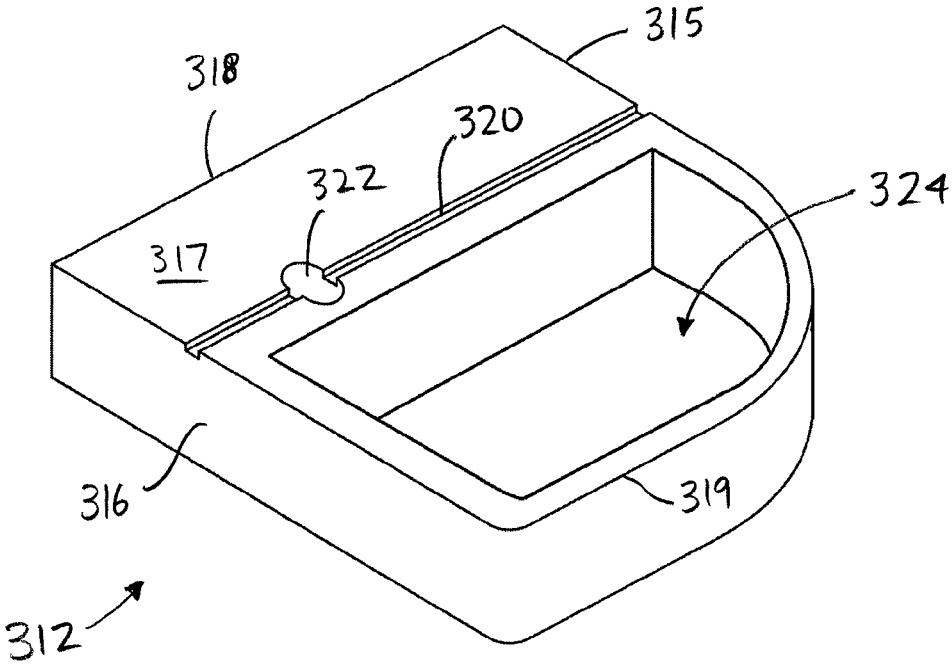
FIG. 11 is a perspective view of a putter head according to yet another embodiment.
Figure 12:
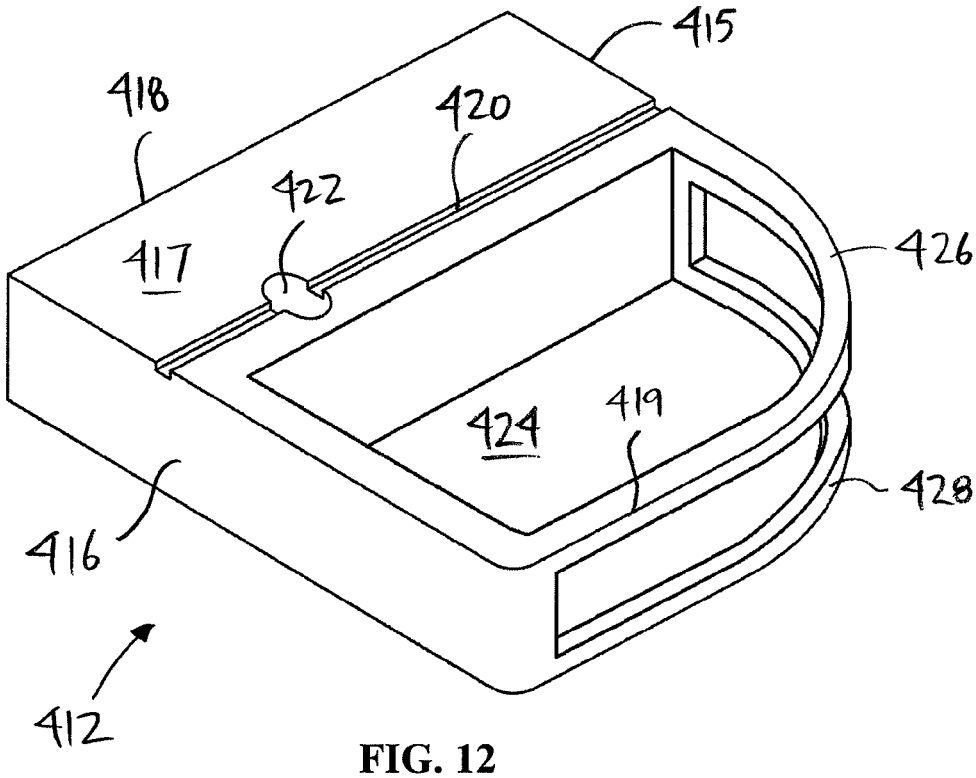
FIG. 12 is a perspective view of a putter head according to another embodiment.

In the embodiment depicted in FIG. 11, for example, the putter head 312 is substantially the same as the putter head 12' shown in FIGS. 6-8 except that the hollow interior volume 324 is not bound by an upper or lower surface such that an area between the visual sight line 320 and the heel edge 319 has a through hole. In this instance, the putter head 312 includes a contact face 316, a top surface 317 extending rearwardly away from the contact face 316, a toe edge 318, and the heel edge 319. The visual sight line 320 may be provided on the top surface 317 and extends rearwardly away from the contact face 316. The visual sight line 320 and the center of gravity are disposed closer to the toe edge 318 than to the heel edge 319 and the visual sight lint 320 extends parallel to the toe edge 318. One or both of the toe edge 318 and visual sight line 320 may extend rearwardly all the way to a rear 315 of the putter head 312. FIG. 12 depicts another possible embodiment in which the putter head 412 is substantially the same as the putter head 312 shown in FIG. 11 except that the hollow interior volume 424 is also not bound by a wall or walls extending along the heel edge 419 and along at least part of the rear of the putter head 412. In this construction, top and bottom flanges 426, 428 may be in the form of upper and lower rails defining outer boundaries of the putter head 412.

Figure 13:
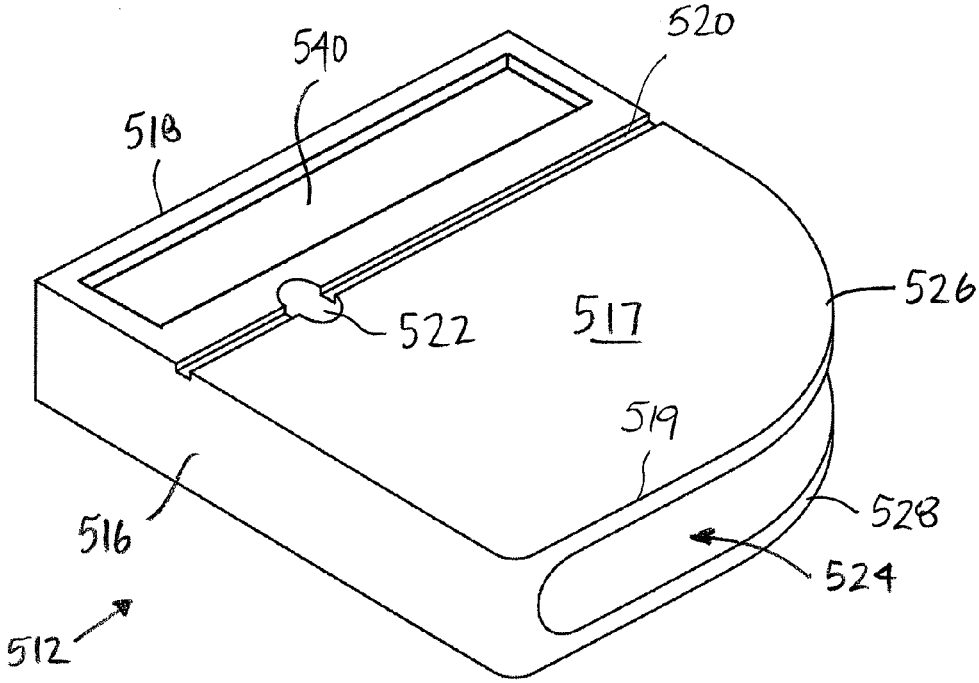
FIG. 13 is a perspective view of a putter head according to another embodiment.

In the embodiment depicted in FIG. 13, for example, the putter head 512 is substantially the same as the putter head 12 shown in FIGS. 1-5 except that at least a portion of the region between the visual sight line 520 and the toe edge 518 may be recessed or removed as indicated at 540. Such a recess 540 may be provided anywhere on the top surface 517 of the putter head 512 and any of the embodiments described herein may include such a recessed portion.

Figure 14:
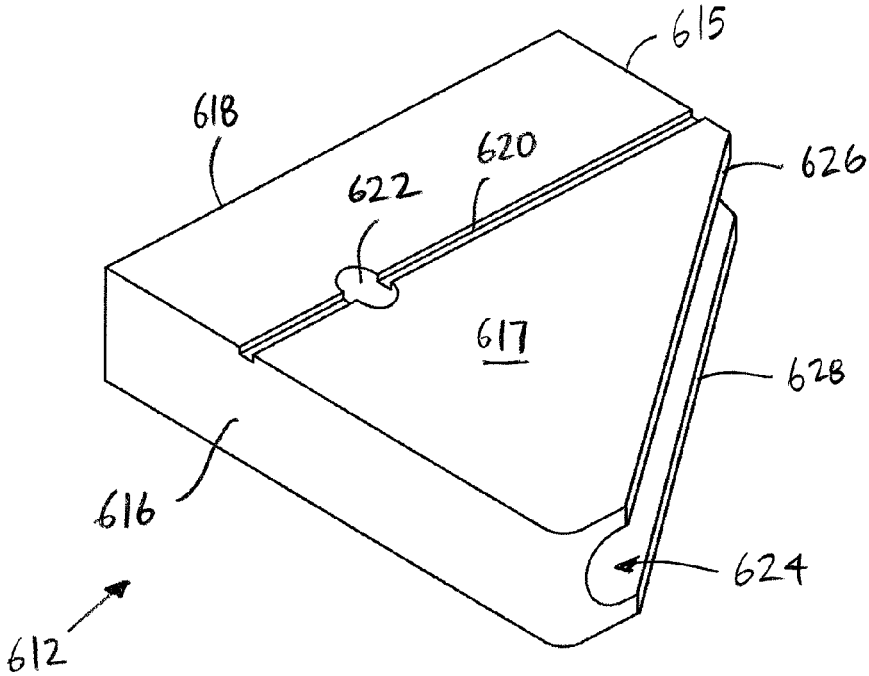
FIG. 14 is a perspective view of a putter head according to another embodiment.

In the embodiment depicted in FIG. 14, for example, the putter head 612 is substantially the same as the putter head 12 shown in FIGS. 1-5 except that the top and bottom flanges 26, 28 are partially removed. Any of the embodiments described herein may include such partial removal of portions of the top surface, the top and bottom flanges, the sole, and side surfaces provided proximate the heel edge and rear of the putter head.

The disposition of the sight line plane SLP as depicted in FIG. 2 is common to all embodiments. That is, in each case, the visual sight line and the center of gravity lie in sight line plane SLP and the sight line plane SLP is arranged substantially perpendicular to the contact face and to the top surface, parallel to the toe edge, and located closer to the toe edge than to the heel edge of the club head. In an embodiment, the sight line plane SLP may be, for example, arranged at a distance of about 0.84 inches to 1.680 inches from the toe edge of the club head, which corresponds to about ½ to 1.0 times the width of a standard golf ball. The resulting effect of this construction is twofold. First, upon initially addressing the golf ball before a putt, the construction allows the golfer to more easily square the contact face to the desired line of ball travel. Second, during the putting stroke, the construction allows the golfer's eyes to see the lines of the toe edge and visual sight line sweep across the putting surface in the desired direction of ball travel. By so maintaining the line of the toe edge, the contact face will necessarily be maintained perpendicular to the desired line of ball travel, thus minimizing the possibility of a mis-hit due to incorrect face angle at impact.

As shown in FIGS. 1, 2, 5-8 and 10-15, the putter head has an exterior surface extending between a rear terminal end of the toe edge and an end of the contact face at the heel edge, which exterior surface has a shape that is generally convex with respect to an intersection of the contact face and the toe edge.

EXAMPLE

Figure 15A:
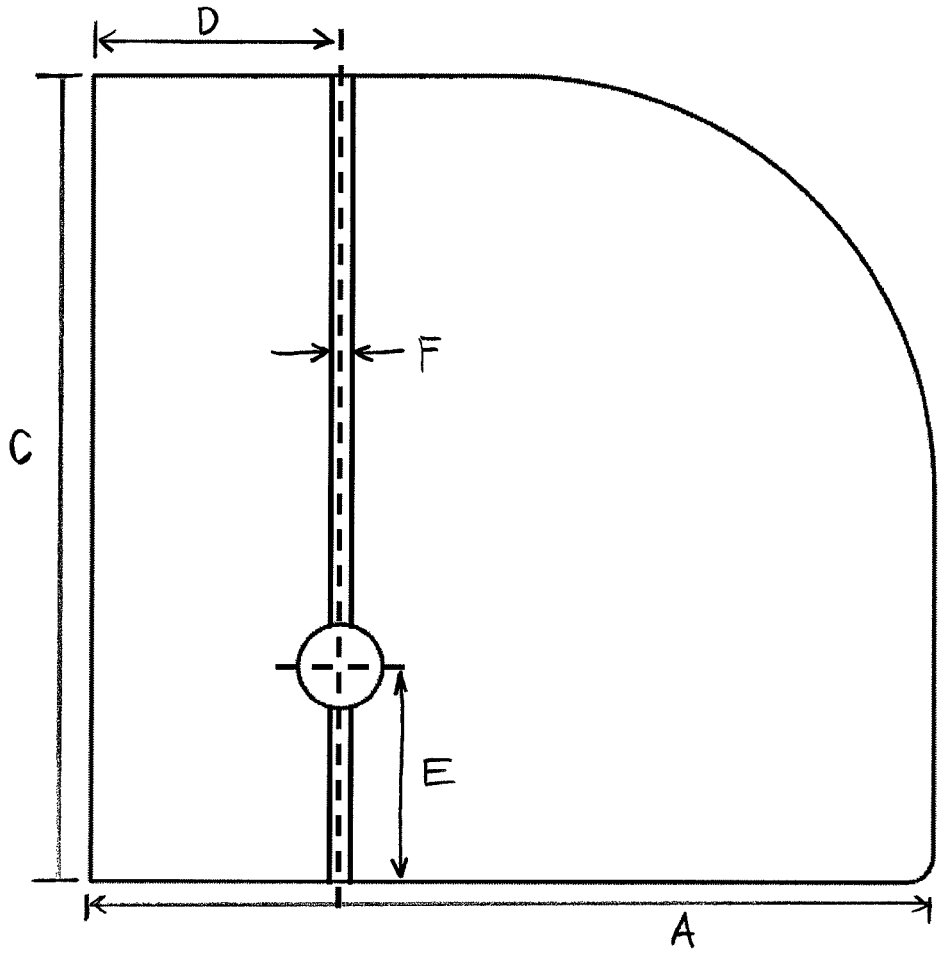
FIGS. 15A and 15B are top and rear views of the putter head according to an embodiment.
Figure 15B:
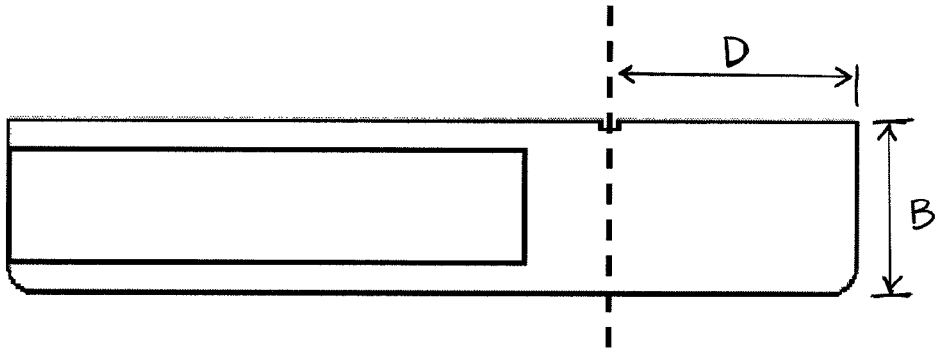

According an embodiment shown in FIGS. 15A and 15B, the putter head may have the following dimensions:

Contact face length (A), measured from toe edge to heel edge: 3.625 in.

Putter head height (B), measured from sole to top surface: 0.750 in.

Putter head depth (C), measured from contact face to rear: 3.400 in.

Distance (D) from toe edge to sight line plane: 1.080 in.

Distance (E) from contact face to the hosel axis: 0.9375 in.

Width (F) of visual sight line: 0.09375 in.

Mass between about 300 g to about 500 g, preferably about 340 g.

The foregoing dimensions are illustrative and non-limiting. Furthermore, in any of the embodiments, the putter head may be constructed from any number of materials such as, for example, but not limited to aluminum, stainless steel, brass, copper, bronze, polymeric materials, beryllium copper, beryllium nickel, alloys of these materials, and combinations thereof.

While various embodiments of the present invention have been described herein, it should be understood that they have been presented by way of example only, and not limitation. Thus, the breadth and scope of the present invention should not be limited by any of the described embodiments, but should instead be defined only in accordance with the following claims and their equivalents.

What is claimed is:

1. A golf putter head comprising:

a contact face, a top surface extending rearward away from the contact face, a toe edge and a heel edge each extending reward from the contact face, and a sole spaced from the top surface, wherein a center of gravity of the putter head is disposed closer to the toe edge than to the heel edge; and a visual sight line on the top surface and extending rearward away from the contact face, wherein the visual sight line and the center of gravity lie in a sight line plane perpendicular to the top surface and to the contact face, wherein the visual sight line extends parallel to the toe edge, and further including an exterior surface extending between a rear terminal end of the toe edge and an end of the contact face at the heel edge, said exterior surface having a shape that is generally convex with respect to an intersection of the contact face and the toe edge.

2. The golf putter head according to claim 1, further comprising a shaft receiving and connection portion.

3. The golf putter head according to claim 2, wherein an axis defined by the shaft receiving and connection portion intersects the sight line plane within the putter head.

4. The golf putter head according to claim 2, wherein the shaft receiving and connection portion comprises a through hole extending between the top surface and the sole.

5. The golf putter head according to claim 1, wherein the toe edge defines an edge of the top surface.

6. The golf putter head according to claim 1, wherein a length of the visual sight line and a length of the toe edge are substantially equal.

7. The golf putter head according to claim 1, wherein the visual sight line comprises an elongated slot formed in the top surface.

8. The golf putter head according to claim 1, wherein the visual sight line comprises a colored strip.

9. The golf putter head according to claim 1, wherein at least a portion of the space between the top surface and the sole is hollow.

10. The golf putter head according to claim 1, wherein at least a portion of the space between the top surface and the sole is filled with a material having a different density than the material of the ton surface and the sole.

11. A golf putter comprising:

a shaft;

a golf putter head comprising:

a contact face, a top surface extending rearward away from the contact face, a toe edge and a heel edge each extending rearward from the contact face, and a sole spaced from the top surface, wherein a center of gravity of the putter head is disposed closer to the toe edge than to the heel edge; and a visual sight line on the top surface and extending rearward away from the contact face, wherein the visual sight line and the center of gravity lie in a sight line plane perpendicular to the top surface and to the contact face, wherein the visual sight line extends parallel to the toe edge, and further including an exterior surface extending between a rear terminal end of the toe edge and an end of the contact face at the heel edge, said exterior surface having a shape that is generally convex with respect to an intersection of the contact face and the toe edge;

said golf putter head connected to an end of the shaft.

12. The golf putter according to claim 11, wherein the golf putter head further comprises a shaft receiving and connection portion, and wherein the end of the shaft is received in and connected to the shaft receiving and connection portion.

13. The golf putter according to claim 12, wherein the shaft receiving and connection portion comprises a through hole extending between the top surface and the sole of the golf putter head.

14. The golf putter according to claim 11, wherein an axis defined by the shaft intersects the sight line plane within the golf putter head.

15. The golf putter according to claim 14, wherein the visual sight line intersects the axis defined by the shaft.

16. The golf putter according to claim 11, wherein a length of the visual sight line and a length of the toe edge are substantially equal.

17. The golf putter according to claim 11, wherein the visual sight line comprises an elongated slot formed in the top surface.

18. The golf putter according to claim 11, wherein the visual sight line comprises a colored strip.

19. The golf putter according to claim 11, wherein at least a portion of the space between the top surface and the sole is hollow.

20. The golf putter according to claim 11, wherein at least a portion of the space between the top surface and the sole is filled with a material having a different density than the material of the top surface and the sole.

21. A method of putting a golf ball, comprising:

providing a golf putter comprising:

a shaft having an end connected to a golf putter head;

said golf putter head comprising:

a contact face, a top surface extending rearward away from the contact face, a toe edge and a heel edge each extending rearward from the contact face, and a sole spaced from the top surface, wherein a center of gravity of the putter head is disposed closer to the toe edge than to the heel edge; and a visual sight line on the top surface and extending rearward away from the contact face, wherein the visual sight line and the center of gravity lie in a sight line plane perpendicular to the top surface and to the contact face, wherein the visual sight line extends parallel to the toe edge, and further including an exterior surface extending between a rear terminal end of the toe edge and an end of the contact face at the heel edge, said exterior surface having a shape that is generally convex with respect to an intersection of the contact face and the toe edge;

utilizing the golf putter to strike the golf ball.

* * * * *